US007887430B1

(12) United States Patent
Henley, Jr.

(10) Patent No.: US 7,887,430 B1
(45) Date of Patent: Feb. 15, 2011

(54) GOLF PUTTER WITH SIGHTING APPARATUS

(76) Inventor: Horace Henley, Jr., 1417 FM 969, Bastrop, TX (US) 78602

( * ) Notice: Subject to any disclaimer, the term of this patent is extended or adjusted under 35 U.S.C. 154(b) by 0 days.

(21) Appl. No.: 12/658,466

(22) Filed: Feb. 8, 2010

(51) Int. Cl.
*A63B 69/36* (2006.01)

(52) U.S. Cl. ..... 473/240; 473/251; 473/267

(58) Field of Classification Search ..... 473/219, 473/226, 231, 238, 240, 241, 242, 268, 267, 473/251; 359/871; 248/475.1, 476, 488
See application file for complete search history.

(56) References Cited

U.S. PATENT DOCUMENTS

| | | | | |
|---|---|---|---|---|
| 1,327,171 | A | 1/1920 | Ruggles | |
| 2,822,614 | A * | 2/1958 | Susinno | 33/263 |
| 2,898,109 | A | 8/1959 | Williams | |
| 3,118,678 | A * | 1/1964 | Rohr | 473/240 |
| 3,170,698 | A | 2/1965 | Schoeffler, et al. | |
| 4,053,160 | A | 10/1977 | Salata | |
| 4,116,448 | A * | 9/1978 | Crowe, Jr. | 473/240 |
| 4,537,403 | A * | 8/1985 | Farina | 473/203 |
| 4,601,472 | A | 7/1986 | O'Flanagan | |
| 4,702,477 | A | 10/1987 | Solomon | |
| 4,789,158 | A | 12/1988 | Chiesa | |
| 4,795,158 | A * | 1/1989 | Kuykendall | 473/201 |
| 4,953,866 | A | 9/1990 | Bang | |
| 5,052,690 | A | 10/1991 | Sharp | |
| 5,071,129 | A | 12/1991 | Wilson | |
| 5,165,691 | A | 11/1992 | Cook | |
| 5,645,493 | A * | 7/1997 | Garcia | 473/203 |
| 5,711,719 | A * | 1/1998 | Fireman | 473/251 |
| 5,842,932 | A * | 12/1998 | Goddard | 473/240 |
| 5,993,327 | A * | 11/1999 | Terril | 473/297 |
| 6,071,197 | A | 6/2000 | Curtis | |
| 6,089,988 | A | 7/2000 | Winslow | |
| 6,447,403 | B1 | 9/2002 | Schmidt | |
| 6,482,100 | B1 | 11/2002 | Bacon | |

* cited by examiner

*Primary Examiner*—Sebastiano Passaniti
(74) *Attorney, Agent, or Firm*—Richard L. Miller

(57) ABSTRACT

A golf putter with sighting apparatus which comprises an elongated shaft. A grip is on an upper end of the elongated shaft. The grip is to be grasped by hands of a golfer. A head is transversely positioned on a lower end of the elongated shaft. The head has a face to strike a golf ball. A support assembly is provided. A mirror has a frame carried on the support assembly. A mechanism is for securing the support assembly onto the elongated shaft above the head. The mirror will be inclined to sight a golf cup on a green spaced from the head, so that the golfer can aim the golf ball into the golf cup on the green.

4 Claims, 4 Drawing Sheets

10
12
14
16
18
30
34
36
40
48
66
68
2
20
22
24
26
28
32
42

12
40
68
66
36
36
34
28
24
16
10

10
12
14
16
16
14
36
32
28
30
24
42
40
40
40

GOLF PUTTER WITH SIGHTING APPARATUS

BACKGROUND OF THE INVENTION

1. Field of the Invention

The present invention relates to a golf club, and more particularly, a golf putter with sighting apparatus.

2. Description of the Prior Art

Numerous innovations for golf putter aid apparatuses have been provided in the prior art that will be described. Even though these innovations may be suitable for the specific individual purposes to which they address, however, they differ from the present invention.

A FIRST EXAMPLE, U.S. Pat. No. 1,327,171, Issued on Jan. 6, 1920, to Ruggles teaches a golf tool provided with a head having a striking face, a reflector positioned above the face and a ball and socket connection between the reflector and the head providing for universal adjustment of the reflector in all planes relative to the striking surface.

A SECOND EXAMPLE, U.S. Pat. No. 2,898,109, Issued on Aug. 4, 1959, to Williams teaches a golf putter apparatus comprising, in combination with a golf putter including a shaft with a blade extending laterally from an end thereof, the blade having a face lying in a substantially vertical plane when the putter is normally held in sighting position by a player, a support, clamping means on the support for securing it to the putter shaft above the blade thereof, an inclined mirror carried by the support and extending longitudinally downwardly at an angle to the vertical plane and transversely parallel to the blade face, the mirror and the putter blade having marks thereof positioned where they can be seen and to align vertically when the putter is in its correct sighting position, and when the putter is moved to make the mirror and blade marks coincide with each other and with the image in the mirror of a golf hole spaced from the putter, the blade face is at right angles to a straight line extending through the hole.

A THIRD EXAMPLE, U.S. Pat. No. 3,170,698, Issued on Feb. 23, 1965, to Schoeffler et al. teaches a golf putter embodying a shaft provided at the lower end thereof with a head having a forward ball driving surface, and means cooperable with the rear surface of the head enabling the user to analyze and familiarize himself with the particular putting situation at hand prior to making the contemplated putt, the means embodying a downwardly inclined forwardly facing mirror having graduations on its viewable face, the graduations defining a range finding scale, the graduations embodying a principal graduation in alignment with a rear center point of the rear surface of the putter head, the mirror and all of its marginal edges being spaced rearwardly from the rear surface and serving to afford the user a panoramic view, whereby he may see the flag on the green and the position of the ball relative thereto, and consequently locate and orient the head of the club relative to the golf ball, and means mounting a median portion of the lower marginal edge only of the mirror on the rearward surface, the means bridging the space between the lower edge and rear surface and being spaced inwardly from the respective transverse ends of the head and mirror, respectively, and embodying a manually adjustable ball and socket joint, whereby the mirror may be universally adjusted relative to the putter head.

A FOURTH EXAMPLE, U.S. Pat. No. 4,053,160, Issued on Oct. 11, 1977, to Salata teaches a golf putting device for practicing putting a golf ball toward a hole by a player with a golf putter club having a putter shaft and a putter face. The invention comprises an alignment member being mounted to the putter shaft to extend in front of and being substantially normal to the plane of the putter face. A reflector element is mounted to be behind the plane of the putter face. The relative position of the alignment member and the reflector element enables the player to observe the alignment member being simultaneously superimposed over the ball and over the reflection of the hole in the reflector element to establish the putter face to be normal to a line extending between the golf ball and the hole. The forward extension of the alignment member is superimposed over the golf ball during substantially all of the putting stroke enabling the player to practice maintaining the putter face normal to the line extending between the golf ball and the hole.

A FIFTH EXAMPLE, U.S. Pat. No. 4,601,472, Issued on Jul. 22, 1986, to O'Flanagan teaches a sighting device for a golf putter comprises a mounting frame housing an eye aligning mirror having a horizontally disposed reflective surface and a ball and target aligning mirror having a reflective surface extending at an angle of approximately 135.degree. to the putting face of the putter blade. The frame includes a front flange which extends downwardly over the putting face of the blade. The device is releasably mounted on the blade by a deformable bonding agent which fills a chamber defined by the rear face of the flange, the striking face of the putter and spaced-apart ribs extending rearwardly of the flange to engage against the striking face. A pair of lugs extend sidewardly of the frame and each is formed with a through hole in which an adjusting screw for adjusting the position of the device on the putter blade are threadingly engaged. The device is used for aligning the putting face of the blade square to a target path between a ball and target while aligning the eye of the player over the target path. The device is adapted for releasably mounting on any putter blade without alteration of the blade so that the putter may be restored to its original condition after the device is removed for use in competitive play under the rules of golf.

A SIXTH EXAMPLE, U.S. Pat. No. 4,702,477, Issued on Oct. 27, 1987, to Solomon teaches a golf putter for putting a ball along a path of desired golf ball travel that includes a head having a planar striking surface. A horizontal extension from the head positions the shaft in a vertical plane ½ inch to 2 inches rearward of the head. The extension provides the connecting link between the shaft and the rear surface of the head and locates the center of gravity of the head between the shaft and the ball to be stroked when the head is in a striking position relative to the ball.

A SEVENTH EXAMPLE, U.S. Pat. No. 4,789,158, Issued on Dec. 6, 1988, to Chiesa teaches a light-weight sighting or aiming device for showing the line of the path of a golf ball to be impacted by a golf club which has a base head adapted to be releasably secured to the shaft of the club at a selected distance above the club head, a rod projecting forwardly from the base head to be aligned parallel with the club head, a pointer selectively mounted at different positions along the length of the rod normal to the axis of the rod and threads on the rod to extend and retract the rod relative to the base head so that the pointer will be positioned over the sweet spot of the hitting face when the golfer addresses the ball. The component parts of the device are preferably light-weight plastics material with the base head having an end spaced for gripping the shaft and with the rod member frictionally threaded for a substantial distance in the base head member. The preferred rod has a plurality of transverse holes therethrough spaced along its length to selectively snugly receive the pointer. The device only weighs about ½ ounce and requires no alteration of the club so that it will have no effect on the feel of the club.

AN EIGHTH EXAMPLE, U.S. Pat. No. 4,953,866, Issued on Sep. 4, 1990, to Bang teaches a golf putter comprising a putting shaft, a putting head having a front face and a rear face, an aperture extending through the putting head from the front face to the rear face thereof, a supporting plate containing a mirror mounted to the rear face of the putting head and extending at an angle from the rear face, the mirror being mounted to coincide with the aperture disposed in the putting head, whereby the golfer, from a putting position can view both the ball and the hole by looking at the surface of the mirror.

A NINTH EXAMPLE, U.S. Pat. No. 5,052,690, Issued on Oct. 1, 1991, to Sharp teaches a golf club alignment device for showing a target area of a golf ball to be impacted by a golf club that has a base head with a center mark calibrated to a center line of a securely mounted reflective plate having a mirror quality finish angled back from the corresponding striking surface of the club head, a centering scale, silhouetted at the base portion of the reflective plate, made up of short lines, 0.125 inch spaced increment deviations on either side of the center line in progressive numerical order to allow the golfer to compensate for contours of putting surfaces, a grip reasonably secured to a shaft, of the club head having at a selected distance above the club head to the shaft, a centering standard projecting horizontally forward and parallel to the club head, an alignment mark existing near out board end of the centering standard, calibrated to the center mark of the club head, also calibrated to center line of the reflective plate, in conjunction with the reflection of alignment mark of the centering standard, thus subsequently positioning the corresponding striking surface of club head perpendicular to the reflection of the target or achieving a misaligned putt by using an offset of the centering scale right or left of center line for compensating for contoured putting surfaces of the putt being negotiated.

A TENTH EXAMPLE, U.S. Pat. No. 5,071,129, Issued on Dec. 10, 1991, to Wilson teaches a golf putting visual aid practice and sighting instrument characterized by its removable attachment to a conventional putter wherein a reflective device is articulably connected rearwardly of a putter head and blade. The reflective device mounts a line of sight marker which may be shifted transversely at the option of the golfer to perfect the relative position of the putter club head to the green and to the target hole.

AN ELEVENTH EXAMPLE, U.S. Pat. No. 5,165,691, Issued on Nov. 24, 1992, to Cook teaches a laser golf club putter assembly including a laser beam assembly mounted on a basic putter club assembly to provide singular or parallel laser beams extended outwardly from a ball contact face section on a club head member. The laser beam assembly includes 1) a power supply having battery members and/or a solar panel member; and 2) a switch control assembly having a manual slide switch or an automatic motion switch member operable in an upright usage position of the basic putter club assembly to energize the laser beam assembly. A second embodiment is a handle mount laser beam assembly mounted within a handle assembly and having means thereon to automatically energize the system with a motion switch member and use a solar panel as a power source. A third embodiment of the laser golf club putter assembly is an add-on mount type having an add-on housing member with an add-on laser beam assembly contained therein operable to be connected to any available basic putter club assembly. The parallel laser beams are mounted in respective inner and outer heel portions of the club head member.

A TWELFTH EXAMPLE, U.S. Pat. No. 6,071,197, Issued on Jun. 6, 2000, to Curtis teaches a device for teaching correct putting that can be attached to the shaft of a putter. A mirror is pivotally attached to an arm which extends behind and is parallel to the face of the putter such that the center of gravity for the mirror is between the pivot point and the face of the putter. The mirror is oriented at such an angle that a golf ball and a target cup can be viewed simultaneously by a golfer using a putter to which the device has been attached. Rotation of the mirror caused by the relative position of the pivot point and the center of gravity for the mirror will, under the influence of gravity, maintain this desired visual image in the mirror throughout the putting stroke. A straight line is placed on the reflecting surface of said mirror in such an orientation that the plane which contains the visible line and which is perpendicular to the reflecting surface of said mirror is perpendicular to the face of the putter and aligned with the desired point of impact on the face of the putter. By aligning the straight line in the middle of both the golf ball and the target cup, a golfer using the device will be assured that the face of the putter is perpendicular to the imaginary line running between the golf ball and the target cup; and maintaining such alignment throughout the stroke of the putter, a golfer using the device will be certain that the golfer's stroke is directly toward the target cup.

A THIRTEENTH EXAMPLE, U.S. Pat. No. 6,089,988, Issued on Jul. 18, 2000, to Winslow teaches a putter alignment device and includes a mounting frame for engaging a putter and for aligning the device relative to the putter face. A mirror frame having a mirror supported thereby is coupled pivotally to the mounting frame for aligning the putter relative to a target. A securing arrangement is adapted to engage the mounting frame at a portion thereof, extend behind the putter, and engage another portion of the mounting frame to attach removably the putter alignment device on the putter. Inventive sight members facilitate positioning of the eyes of the golfer relative to the target line as a part of the alignment method.

A FOURTEENTH EXAMPLE, U.S. Pat. No. 6,447,403, Issued on Sep. 10, 2002, to Schmidt teaches an improved method of swinging a putter which includes an improved putter and a swinging stance of specific features. The elements of the swinging method include gripping the putter in the traditional fashion, securing at least one hand or a butt end of the hand grip against some part of the lower body, moving the putter head back through an arcuate path, and retracing the arcuate path to strike the golf ball. The improved putter includes a putter head attached to one end of the shaft, and hand grip attached to the other end of the shaft. In a second embodiment, the shaft extends from the putter head at an angle of between 35 to 85 degrees from the vertical axis.

A FIFTEENTH EXAMPLE, U.S. Pat. No. 6,482,100, Issued on Nov. 19, 2002, to Bacon teaches a golf putter having a reflective face and alignment guide including a head portion having a forward face and a rearward face. The head portion has an upper end and a lower end. The upper end has a collar extending upwardly therefrom for receiving a golf shaft therein. The forward face has an upper section and a lower section. The lower section is vertically oriented and essentially perpendicular to the lower end. The upper section is angularly disposed and essentially less than forty-five degrees with respect to the lower section. The upper section has a mirror secured thereto. An alignment tab is secured to and extends rearwardly from the upper end of the head portion. The alignment tab has a central alignment recess formed therein. The recess has a forward end disposed above the mirror secured to the upper section of the head portion.

It is apparent now that numerous innovations for golf putter aid apparatuses have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a golf putter with sighting apparatus that avoids the disadvantages of the prior art.

ANOTHER OBJECT of the present invention is to provide a golf putter with sighting apparatus that is simple and inexpensive to manufacture.

STILL ANOTHER OBJECT of the present invention is to provide a golf putter with sighting apparatus that is simple to use.

BRIEFLY STATED, STILL YET ANOTHER OBJECT of the present invention is to provide a golf putter with sighting apparatus which comprises an elongated shaft. A grip is on an upper end of the elongated shaft. The grip is to be grasped by hands of a golfer. A head is transversely positioned on a lower end of the elongated shaft. The head has a face to strike a golf ball. A support assembly is provided. A mirror has a frame carried on the support assembly. A mechanism is for securing the support assembly onto the elongated shaft above the head. The mirror will be inclined to sight a golf cup on a green spaced from the head, so that the golfer can aim the golf ball into the golf cup on the green.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Figures 1, 2:
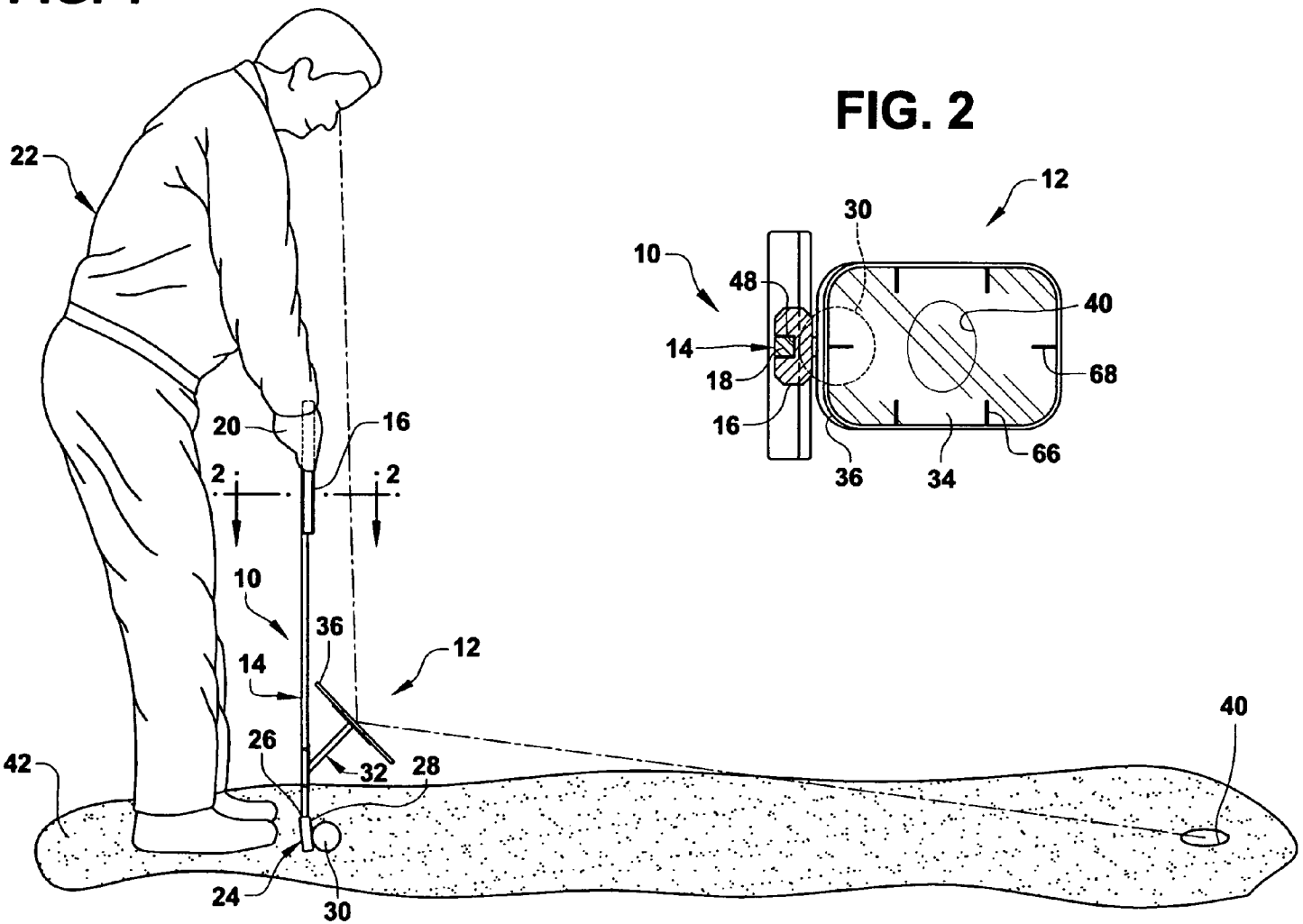
FIG. 1 is a diagrammatic perspective view of an embodiment of the present invention in use.
FIG. 2 is a diagrammatic cross sectional view taken along line 2-2 of FIG. 1.
Figures 3, 4:
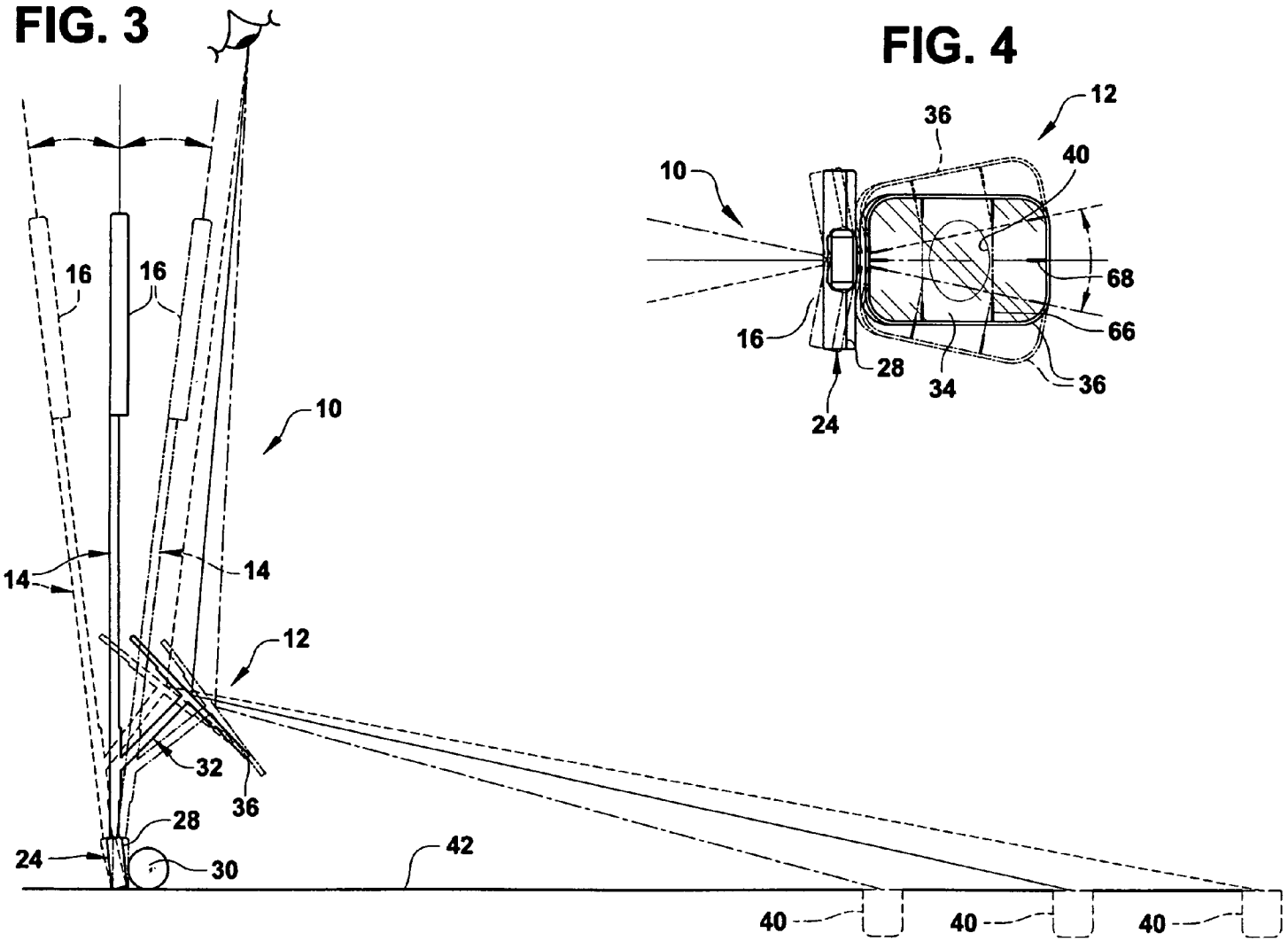
FIG. 3 is a diagrammatic side view of the present invention showing multiple alignments for use in lining up the cup for a putt close, medium and far.
FIG. 4 is a diagrammatic top view of the present invention showing multiple alignments for use in lining up the cup for a putt from side to side.

10 golf putter
12 sighting apparatus of golf putter 10
14 elongated shaft of golf putter 10
16 grip of golf putter 10
18 upper end of elongated shaft 14
20 hand of golfer 22
22 golfer
24 head of golf putter 10
26 lower end of elongated shaft 14
28 face of head 24
30 golf ball
32 supporting assembly of golf putter 10
34 mirror of golf putter 10
36 frame of mirror 34
38 securing mechanism of golf putter 10
40 golf cup on green 42
42 green
44 threaded bore in forward flat portion 46
46 forward flat portion of elongated shaft 14
48 rear vertical slot in grip 16
50 arm of support assembly 32
52 mounting plate of support assembly 32
54 mounting hole in mounting plate 52
56 first end of arm 50
58 mounting bolt of support assembly 32
60 narrow base plate of securing mechanism 38
62 second end of arm 50
63 aperture in narrow base plate 60
64 base bolt of securing mechanism 38
66 horizontal indicator line on mirror 34
68 centering indicator line on mirror 34

DETAILED DESCRIPTION OF THE PREFERRED EMBODIMENT

Figures 5, 6:
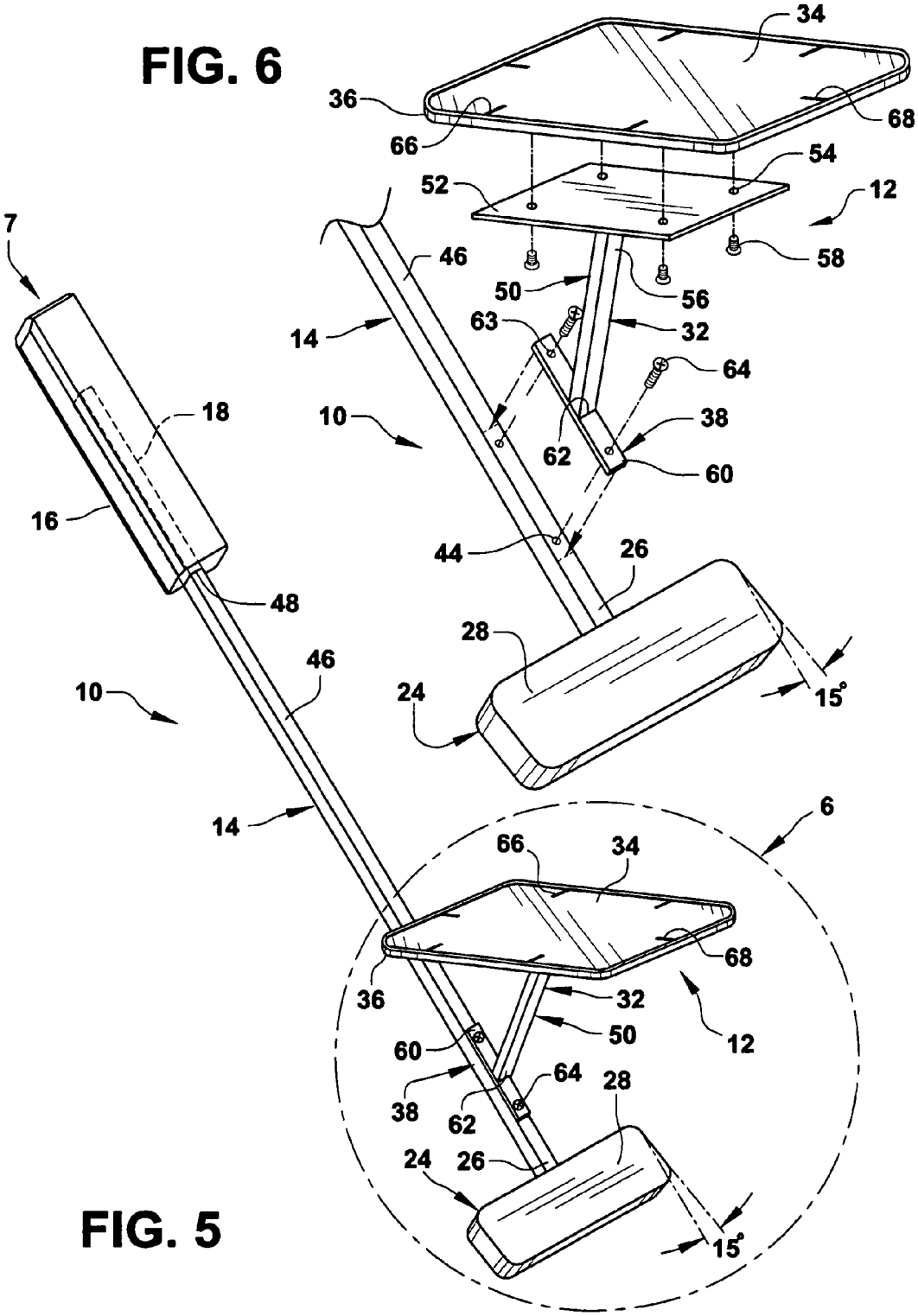
FIG. 5 is a diagrammatic perspective view of the present invention.
FIG. 6 is a diagrammatic exploded perspective view of the area in FIG. 5 indicated by arrow 6.
Figure 7:
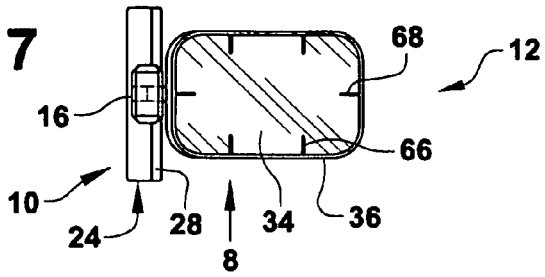
FIG. 7 is a diagrammatic top view taken in the direction of arrow 7 in FIG. 5.
Figure 8:
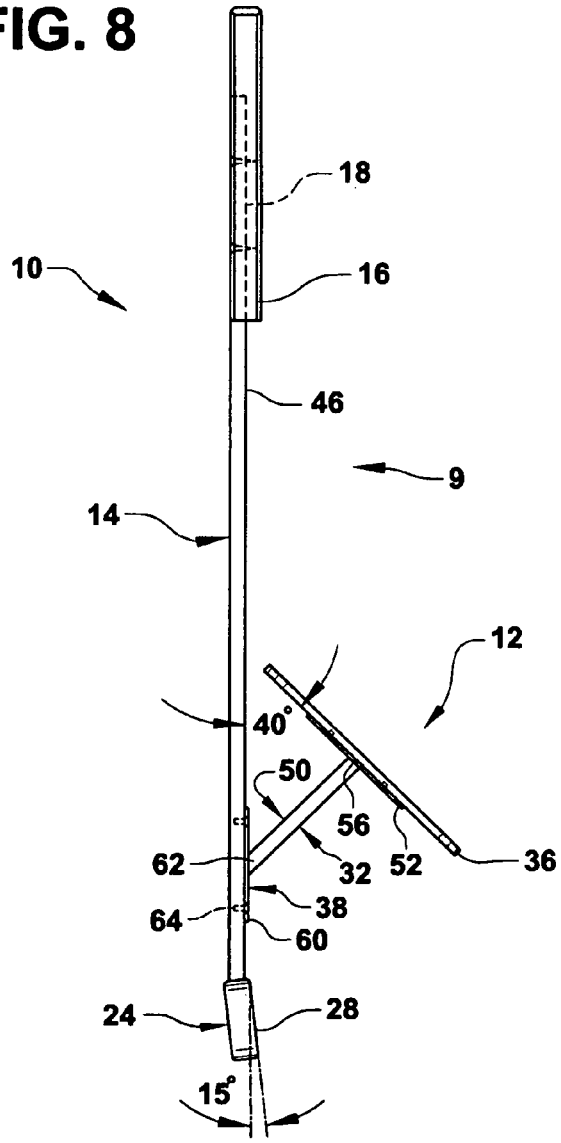
FIG. 8 is a diagrammatic side view taken in the direction of arrow 8 in FIG. 7.
Figure 9:
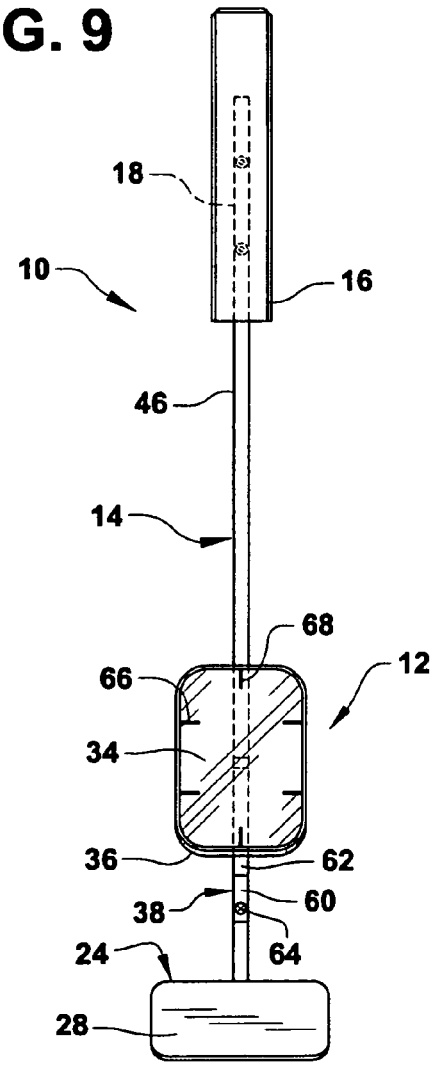
FIG. 9 is a diagrammatic front view taken in the direction of arrow 9 in FIG. 8.

Referring now to the figures, in which like numerals indicate like parts, and particularly to FIGS. 1 through 9, which are a diagrammatic perspective view of an embodiment of the present invention in use; a diagrammatic cross sectional view taken along line 2-2 of FIG. 1; a diagrammatic side view of the present invention showing multiple alignments for use in lining up the cup for a putt close, medium and far; a diagrammatic top view of the present invention showing multiple alignments for use in lining up the cup for a putt from side to side; a diagrammatic perspective view of the present invention; a diagrammatic exploded perspective view of the area in FIG. 5 indicated by arrow 6; a diagrammatic top view taken in the direction of arrow 7 in FIG. 5; a diagrammatic side view taken in the direction of arrow 8 in FIG. 7; and a diagrammatic front view taken in the direction of arrow 9 in FIG. 8, and as such, will be discussed with reference thereto.

The present invention is a golf putter 10 with sighting apparatus 12 which comprises an elongated shaft 14. A grip 16 is on an upper end 18 of the elongated shaft 14. The grip 16 is to be grasped by hands 20 of a golfer 22. A head 24 is transversely positioned on a lower end 26 of the elongated shaft 14. The head 24 has a face 28 to strike a golf ball 30. A support assembly 32 is provided. A mirror 34 has a frame 36 carried on the support assembly 32. A mechanism 38 is for securing the support assembly 32 onto the elongated shaft 14 above the head 24. The mirror 34 will be inclined to sight a golf cup 40 on a green 42 spaced from the head 24, so that the golfer 22 can aim the golf ball 30 into the golf cup 40 on the green 42.

The elongated shaft 14 is square shaped in cross section and has two spaced apart threaded bores 44 in a forward flat portion 46 of the elongated shaft 14. The grip 16 is square shaped in cross section and has a rear vertical slot 48 that fits against and mounted to the square shaped elongated shaft 14. The head 24 extends at a forward angle of approximately fifteen degrees to the vertical of the elongated shaft 14.

The support assembly 32 comprises an arm 50. A mounting plate 52 has a plurality of mounting holes 54. The mounting plate 52 is affixed to a first end 56 of the arm 50. A plurality of mounting bolts 58 extend through the mounting holes 54 to retain the frame 36 of the mirror 34 onto the mounting plate 52.

The securing mechanism 38 comprises a narrow base plate 60 affixed angularly to a second end 62 of the arm 50. The narrow base plate 60 has two spaced apart apertures 63. A pair of base bolts 64 are provided. Each base bolt 64 extends through one aperture 63 in the narrow base plate 60 and into one threaded bore 44 in the forward flat portion 46 of the elongated shaft 14.

The mirror 34 extends at an angle of approximately forty degrees to the vertical of the elongated shaft 14. The mirror 34 further comprises four horizontal indicator lines 66 and two centering indicator lines 68 to properly align the face 28 of the head 24 with respect to the golf cup 40 on the green 42 to allow the golfer 22 to strike the golf ball 30 into the golf cup 40.

It will be understood that each of the elements described above, or two or more together, may also find a useful application in other types of constructions differing from the types described above.

While the invention has been illustrated and described as embodiments of a golf putter with sighting apparatus accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A golf putter with sighting apparatus which comprises:

A) an elongated shaft;

B) a grip on an upper end of said elongated shaft, said grip to be grasped by hands of a golfer;

C) a head transversely positioned on a lower end of said elongated shaft, said head having a face to strike a golf ball;

D) a support assembly;

E) a mirror having a frame carried on said support assembly; and

F) means for securing said support assembly onto said elongated shaft above said head, wherein said mirror will be inclined to sight a golf cup on a green spaced from said head, so that the golfer can aim the golf ball into the golf cup on the green;

wherein said elongated shaft is square shaped in cross section and having two spaced apart threaded bores in a forward flat portion of said elongated shaft;

wherein said grip is square shaped in cross section having a rear vertical slot that fits against and mounted to said square shaped elongated shaft, wherein said head extends at a forward angle of approximately fifteen degrees to the vertical of said elongated shaft, wherein said support assembly comprises:

a) an arm;

b) a mounting plate having a plurality of mounting holes, said mounting plate affixed to a first end of said arm; and c) a plurality of mounting bolts extending through said mounting holes to retain said frame of said mirror onto said mounting plate.

2. The golf putter as recited in claim 1, wherein said securing means comprises:

a) a narrow base plate affixed angularly to a second end of said arm, said narrow base plate having two spaced apart apertures; and b) a pair of base bolts, each said base bolt extending through one said aperture in said narrow base plate and into one said threaded bore in said forward flat portion of said elongated shaft.

3. The golf putter as recited in claim 2, wherein said mirror extends at an angle of approximately forty degrees to the vertical of said elongated shaft.

4. The golf putter as recited in claim 3, wherein said mirror further comprises four horizontal indicator lines and two centering indicator lines to properly align said face of said head with respect to the golf cup on the green to allow the golfer to strike the golf ball into the golf cup.

* * * * *